United States Patent [19]

Schaub et al.

[11] Patent Number: 4,540,071

[45] Date of Patent: Sep. 10, 1985

[54] CASE WITH AN OBSTACLE-FREE BASIC FRAME ELEMENT, LATERAL ELEMENTS AND DIFFERENT TYPES OF ADDITIONAL ELEMENTS

[75] Inventors: Michael M. Schaub, Basel; Jörg Zintzmeyer, Zürich, both of Switzerland

[73] Assignee: Zintmeyer & Lux AG, Switzerland

[21] Appl. No.: 525,042

[22] Filed: Jul. 6, 1983

[30] Foreign Application Priority Data

Nov. 12, 1981 [EP] European Pat. Off. ..... 81109646.0

[51] Int. Cl.[3] ..... A45C 3/02

[52] U.S. Cl. ..... 190/121

[58] Field of Search ..... 190/122, 121, 123, 127, 190/103; 220/4 R, 4 A, 4 B, 4 C

[56] References Cited

U.S. PATENT DOCUMENTS

| | | | |
|---|---|---|---|
| 1,950,118 | 3/1934 | Lifton . | |
| 2,885,070 | 5/1959 | Ondrejka | 220/4 C X |
| 3,579,804 | 5/1971 | Slan | 190/121 X |
| 3,830,348 | 8/1974 | Ohyama . | |
| 4,020,930 | 5/1977 | Weber | 190/121 X |

FOREIGN PATENT DOCUMENTS

| | | |
|---|---|---|
| 2213267 | 9/1973 | Fed. Rep. of Germany . |
| 638359 | 5/1928 | France . |
| 982799 | 6/1951 | France . |
| 2157245 | 1/1973 | France . |
| 2018580 | 10/1979 | United Kingdom . |

*Primary Examiner*—Steven M. Pollard

*Attorney, Agent, or Firm*—Roylance, Abrams, Berdo & Goodman

[57] ABSTRACT

The novel case contains at least one rigid, obstacle-free basic frame element with a U-shaped profile and laterally fittable, interchangeable lateral elements. The latter can be in the form of e.g. plates, case shells or lateral covers provided with roller shutters.

The case can be opened between the basic frame element and one of the lateral elements.

The volume within the profile makes it possible to receive different additional elements. Examples of the latter are locking elements, carrying handles, name plates, identification elements, accessories, roller elements and carrying straps.

The basic frame element can be in the form of a rectangle, square, polygon or circle.

9 Claims, 29 Drawing Figures

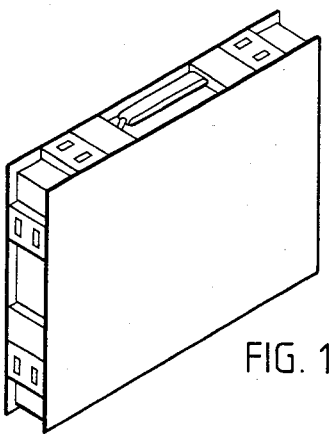
FIG. 10
FIG. 11
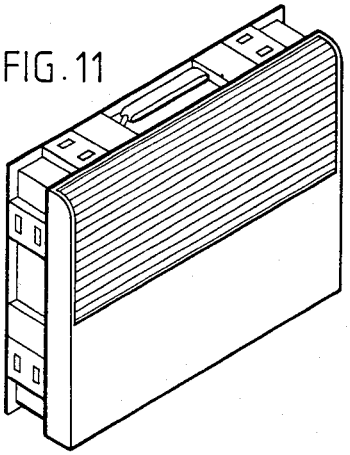
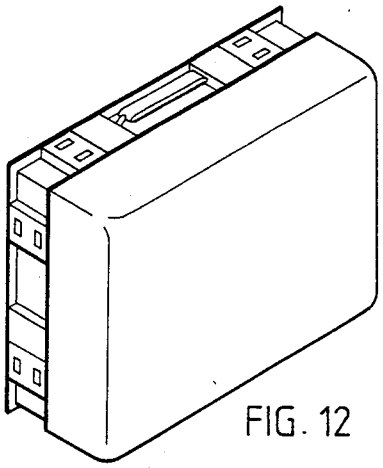
FIG. 12
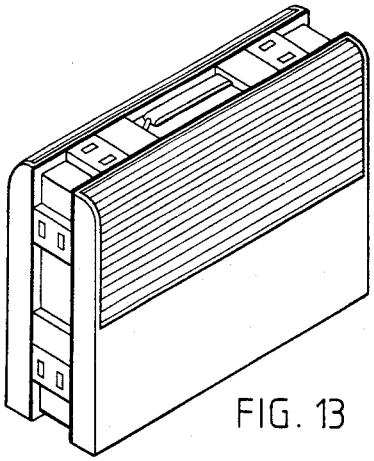
FIG. 13
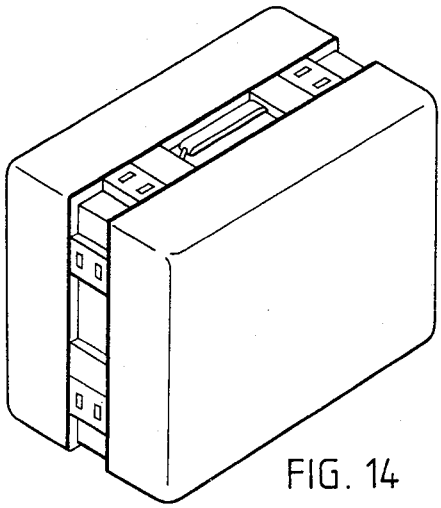
FIG. 14
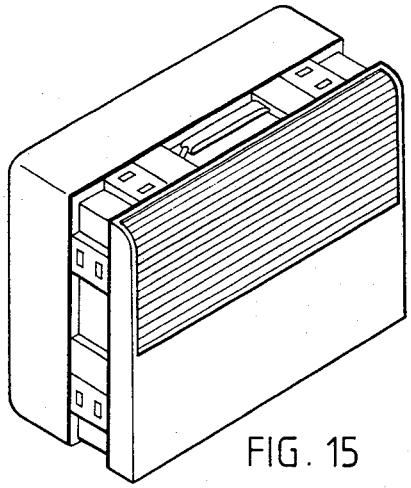
FIG. 15

CASE WITH AN OBSTACLE-FREE BASIC FRAME ELEMENT, LATERAL ELEMENTS AND DIFFERENT TYPES OF ADDITIONAL ELEMENTS

FIELD OF THE INVENTION

The present invention relates to a case having at least one rigid, internally obstacle-free basic frame element and matching, interchangeable lateral elements.

BACKGROUND OF THE INVENTION

The standard case construction comprises interconnecting two shell-like elements by means of hinges and to lock them by locking means provided on either side. In the case of the conventional case construction, there are extremely limited possibilities of adapting to different transportation requirements (volume change, function change), because the enclosed volume cannot be carried as a result of the fixed interconnection of the shells.

Presently available case constructions with a variable volume consist inter alia of:

(a) fabric cases, with the disadvantage of poor protection of the articles transported, due to the soft outer wall, (b) cases with bellows integrated into the shells, but which only permit a limited volume change;

(c) the so-called twin case, which comprises a conventional case, with additional hooks and locking elements, in order to receive an additional lateral case shell, but here again there are only relatively limited variability possibilities.

U.S. Pat. No. 1,950,118 (Lifton, 1931) describes a case formed from at least one central part and two lateral covering parts, in which the central part can be folded up and packed into the lateral parts. The central part of the case according to this U.S. Patent is not rigid and does not have a ⊔-shaped profile. In addition, the joints 43 and detachable hinges 49 constitute obstacles in the inner area.

French Pat. No. 2,157,245 (Kalamozoo, 1971) teaches and claims a case with a rigid central part and fixed, removable side walls. The central part has an inner, rigid partition 11 with two compartments 15, 18 and the side walls have studs for receiving perforated papers, probably computer outputs. Thus, the case according to this French Patent lacks the obstacle-free inner area in the central part, whose strength is achieved by destroying the inner free area by incorporating a partition, as well as the ⊔-shaped profile of the basic frame element. The locking elements 13 project and the carrying handle 12 cannot be lowered.

French Pat. No. 982,799 (ALFINA, 1949) relates to a case comprising a plurality of elements, between which the case can be opened, in order to everywhere have free access to the case content, even if the latter has a considerable depth (p.1, left-hand column, lines 1 to 4 of the description). However, the case has a complicated internal partitioning, cf FIGS. 3, 4 and 5. One embodiment of this invention only has a central part (FIG. 2). Furthermore, the case according to FIG. 2 of this French Patent does not show the internal, obstacle-free strength-imparting basic frame element with a ⊔-shaped profile.

DOS No. 2,213,267 (ROEHRICHT, 1972) claims a case whose strength results from a rigid partition 3 in the central area, in the same way as in French Pat. No. 2,157,245. In addition, parts of the case sides are not formed by the central parts, but by lateral parts 6. At these points, the central part is essentially only the rigid partition. The profile of the case according to FIGS. 4 to 6 of this DOS is not ⊔-shaped throughout, the inner area is not free from obstacles and is not possible to incorporate additional elements all round the profile.

SUMMARY OF THE INVENTION

The case construction according to the invention inter alia permits a greater adaptation to the goods being transported, both from the volume and the function standpoints, because the lateral additional elements can be designed for special needs, without limiting the general usability of the remaining elements.

Additional elements having the following functions can be incorporated:

- protection against slipping by a rubber layer carrying projections,
- connecting element between two basic elements,
- outer pocket,
- carrier wall for different accessories,
- bellows elements,
- roller shutter,
- clothing receptacle,
- photographic pocket,
- receptacle for electronic equipment (computer, dictating machine, radio, tv)
- file container,
- hanging or suspended filing system container,
- transition element between too large basic frame and too small additional element.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIGS. 10–23 are perspective views of cases according to various embodiments of the present invention;

DETAILED DESCRIPTION OF PREFERRED EMBODIMENTS

Figure 1:
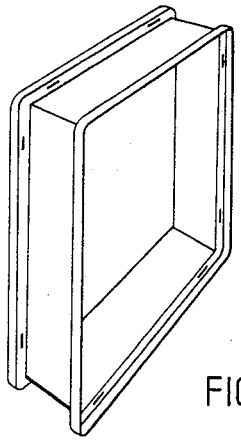
FIGS. 1–5 are perspective views of basic frame elements according to various embodiments of the present invention.
Figure 2:
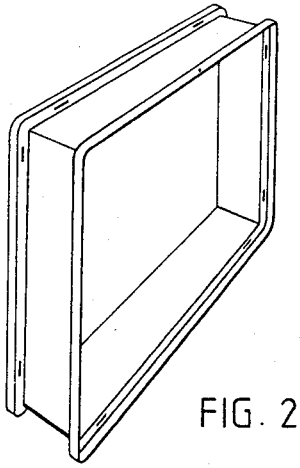
Figure 3:
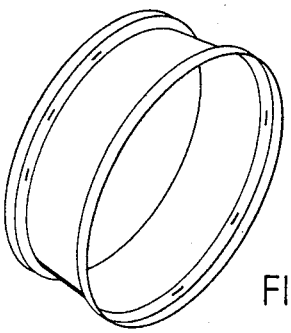
Figure 4:
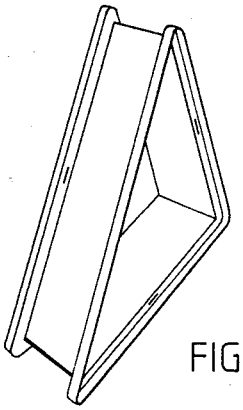
Figure 5:
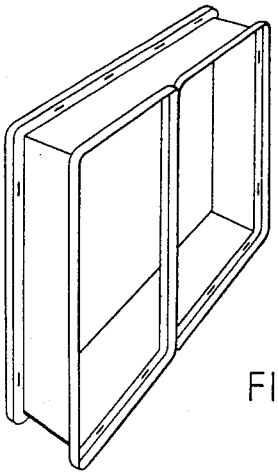

FIGS. 1 to 5 show the possible shapes of the basic element. FIG. 1 permits the fitting of in each case two additional elements per frame side in in each case two positions, because this basic frame is square and consequently makes it possible for the additional elements to be turned by 90°. FIG. 2 shows a rectangular frame for receiving A-format documents. FIG. 3 is a circular basic element, which can receive a large number of additional elements. FIG. 4 is a basic element in the form of an equilateral triangle, which makes it possible to receive 2×3 additional elements. It is possible that a large number of basic geometrical shapes is possible, e.g. a hexagon, which has the advantage of honeycomb-like stackability. FIG. 4 is a rectangular basic element, which is subdivided on one side, so as to permit the reception of smaller lateral elements. This function could also be taken over by a correspondingly shaped additional element, equipped with a locking member, in order to receive several smaller additional elements.

Figure 6:
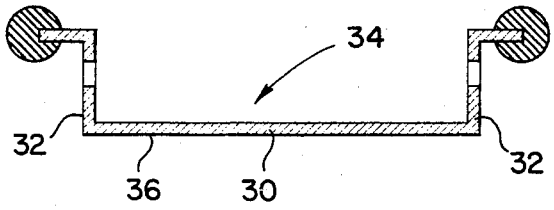
FIGS. 6 and 7 are side elevational views in section of basic frame elements according to the present invention.
Figure 7:
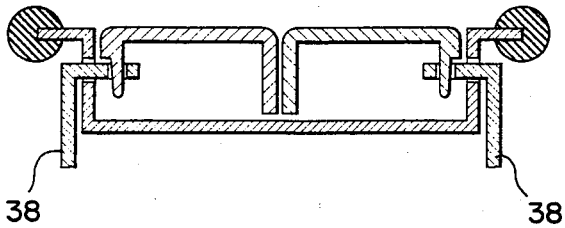

FIGS. 6 and 7 show a cross-section through a possible metal profile, from which the frame of the basic element can be constructed. FIG. 6 shows a profile with laterally fitted rubber profiles for edge protection purposes, wherein the unitary basic element includes in tranverse cross section a base member 30 and two leg members 32 extending outwardly and substantially perpendicularly from the end of the base member. The leg and base members define an outwardly opening recess 34 with a substantially smooth inner surface 36. FIG. 7 shows this profile with fitted lateral elements, which can be laterally inserted through the slots in the profile of the basic element and which make it possible to secure locking members located in the basic element profile. The locking members are merely intimated in the drawing.

Figure 8:
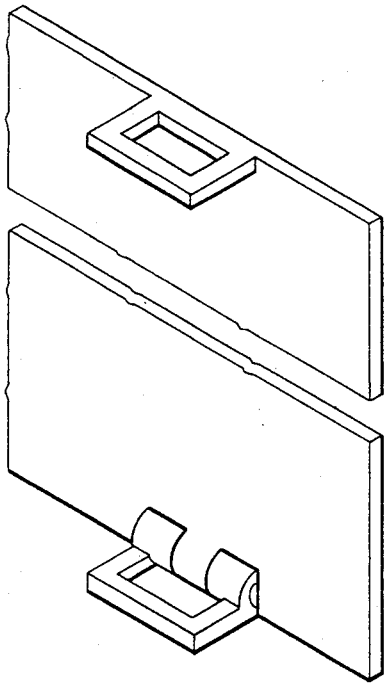
FIG. 8 is a perspective view of a side or lateral element according to the present invention.

FIG. 8 shows two of the possible hook shapes, which can be fitted to the lateral elements and into which the basic elements can be inserted through the slots. The top hook is rigidly connected to the lateral element, whilst the bottom hook is connected thereto by means of a hinge, which makes it possible to fold the lateral elements out of the basic element.

Figure 9:
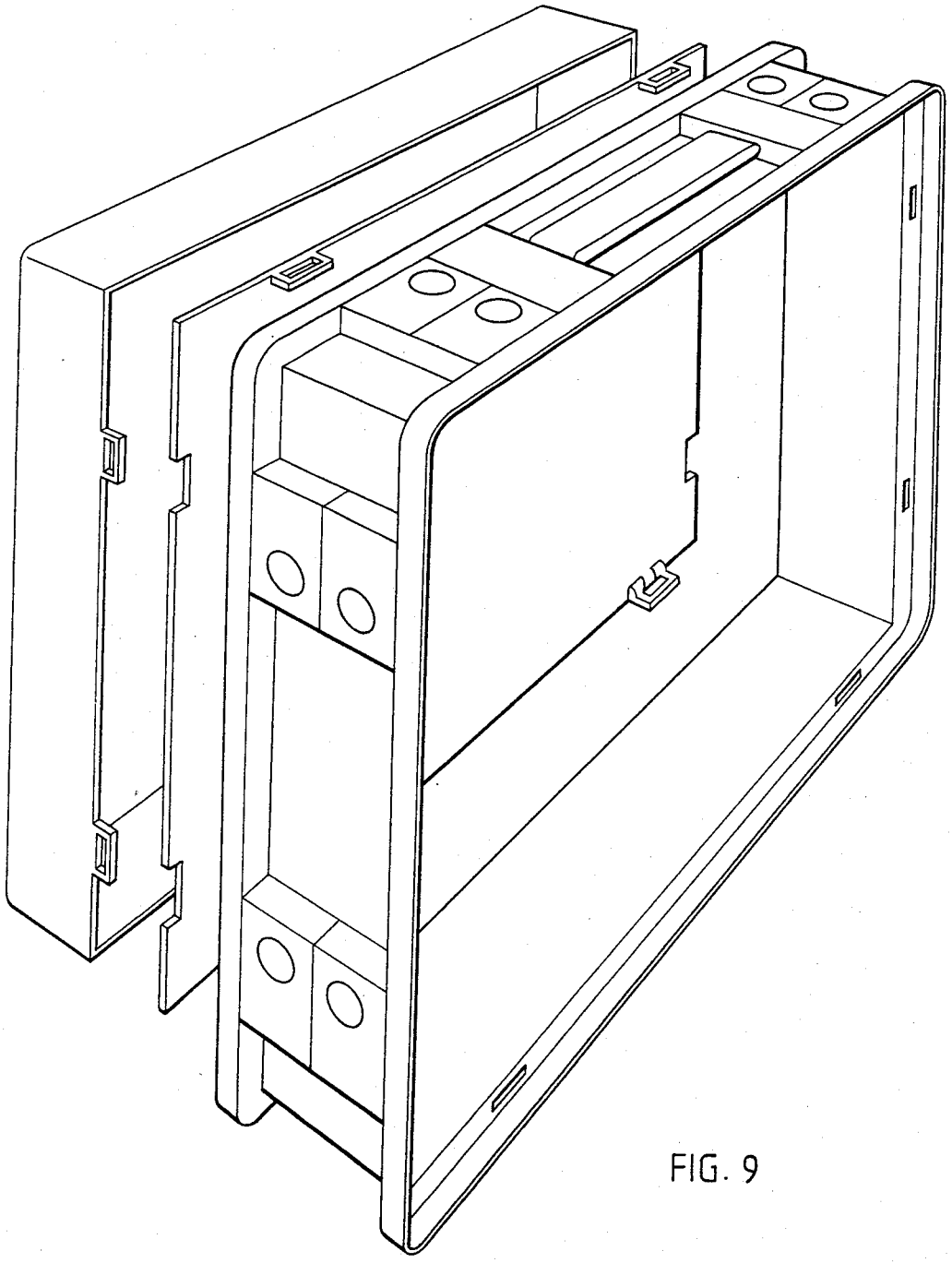
FIG. 9 is a perspective, exploded view of a partial case according to the present invention.

FIG. 9 shows a basic element with locking members fitted therein and a lowerable carrying handle fitted thereto. There are two lateral elements on one side of the basic element and they can be either fitted singly or together. The outer lateral element engages by means of its hooks into the vertical sides of the basic element. The plate-like lateral element has small recess on its vertical edges, in order to permit the engagement of the hooks of the outer additional elements into the basic element. The plate-like lateral element is fixed to the horizontal sides of the basic element and has hooks on the lower edge, which are provided with hinges, in order to permit a flapping out of the lateral element.

FIGS. 10 to 15 show cutouts from the possible combinations of a basic element and different lateral and additional elements. The lateral elements comprise covers, covers with incorporated roller shutters and case shells.

Figure 16:
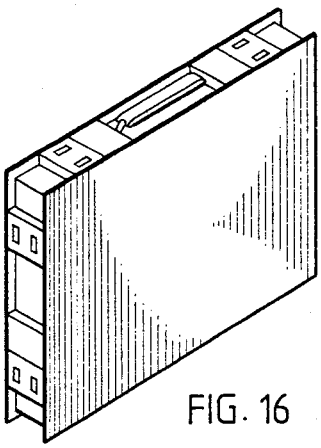
Figure 17:
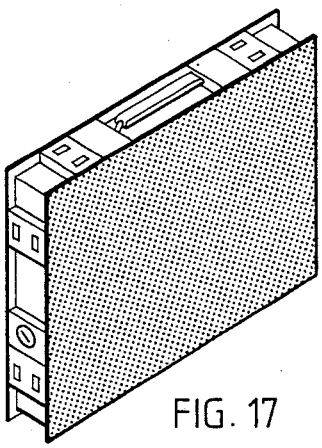
Figure 18:
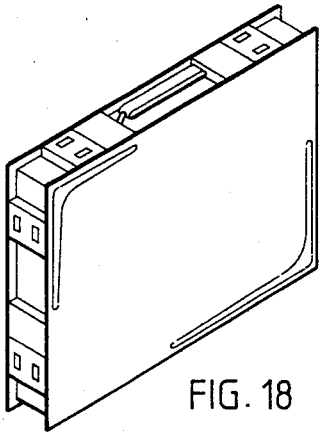

FIGS. 16 to 18 show the possible variations for the additional elements. It is possible to simply change the appearance of the overall object by the varying design of the individual parts. FIG. 16 shows a lateral element of anodized aluminium, FIG. 17 with a rubber layer having projections to prevent slipping and FIG. 18 lined with black leather.

Figure 19:
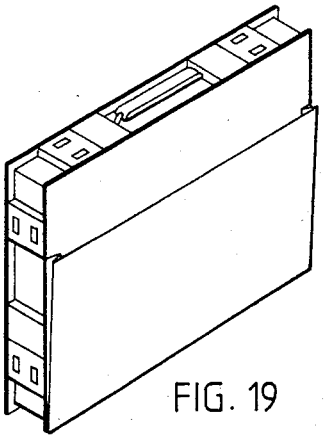
Figure 20:
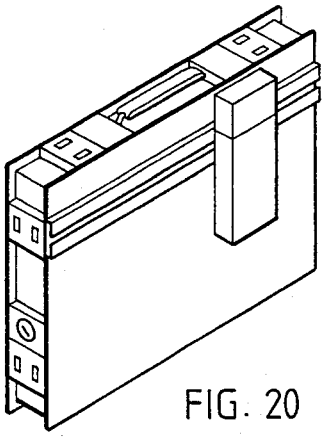
Figure 21:
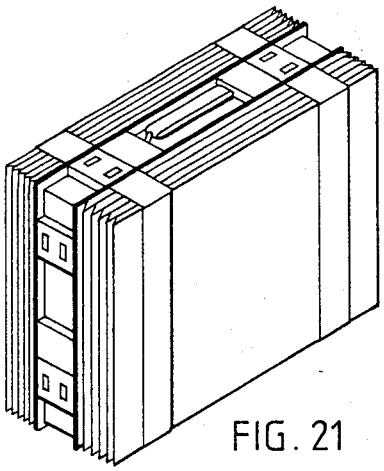

FIGS. 19 to 21 show variation possibilities through the use of specialized lateral elements. FIG. 19 shows a lateral element with an outer pocket, FIG. 20 with a receiving rail for fixing accessories and FIG. 21 with bellows.

Figure 22:
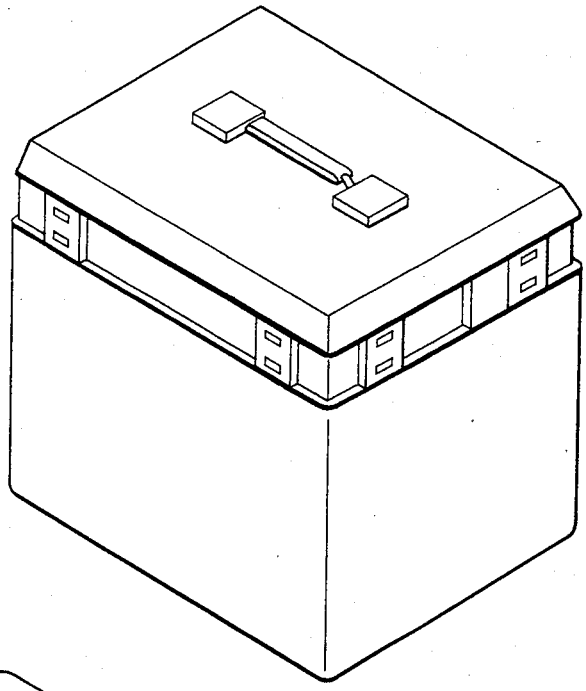

FIG. 22 shows the construction of a beauty case formed from a horizontal basic element and additional top and bottom elements.

Figure 23:
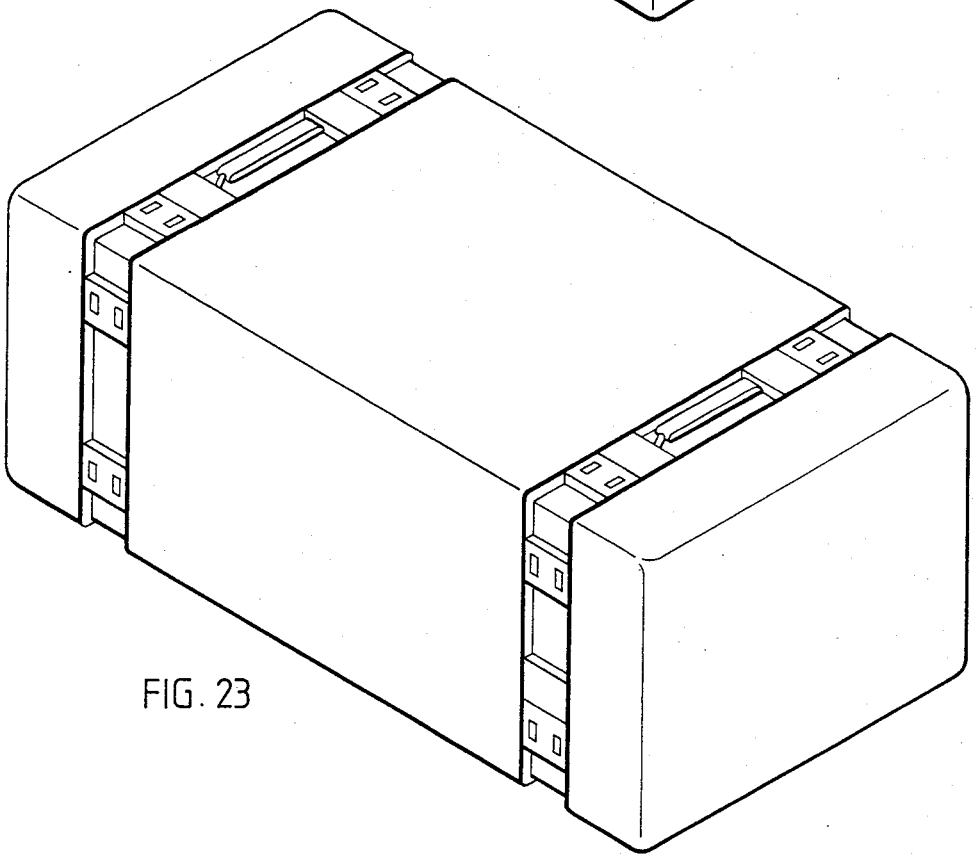

FIG. 23 shows the construction of a so-called overseas case using at least two basic element and a tubular lateral element connecting them, as well as the lateral additional elements.

Figure 24:
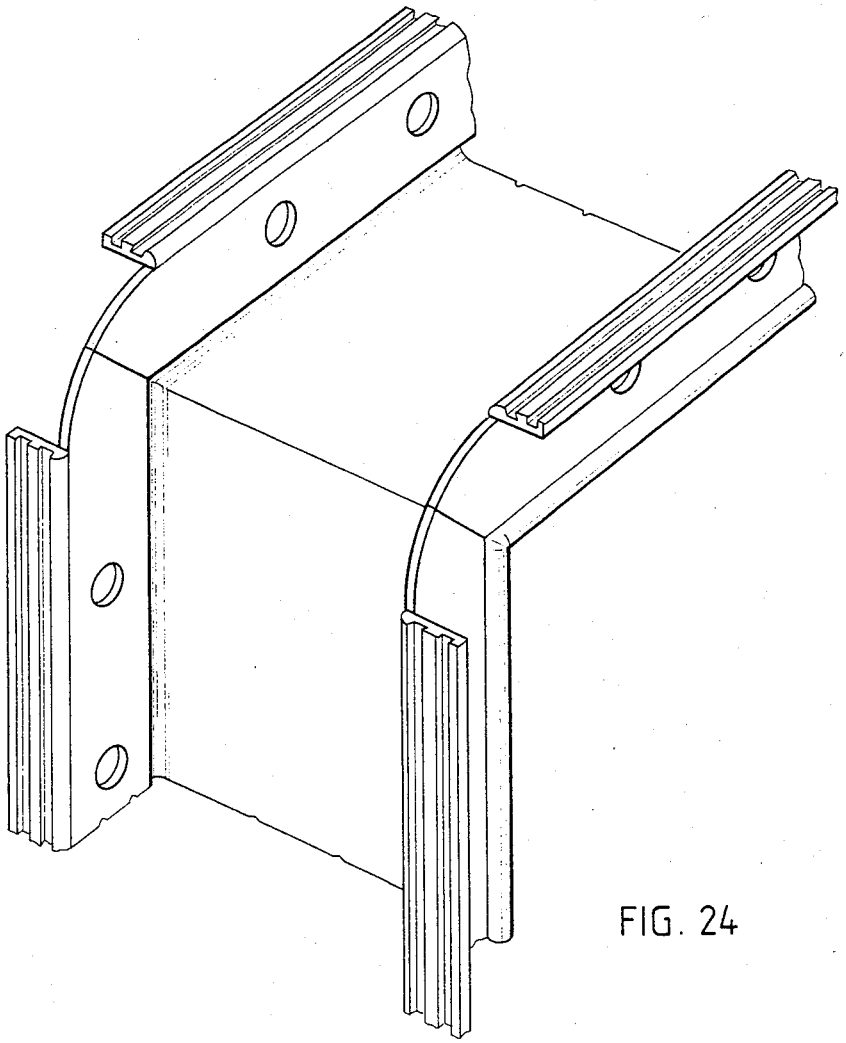
FIGS. 24 and 25 are partial perspective views of corner arrangements according to the present invention.
Figure 29:
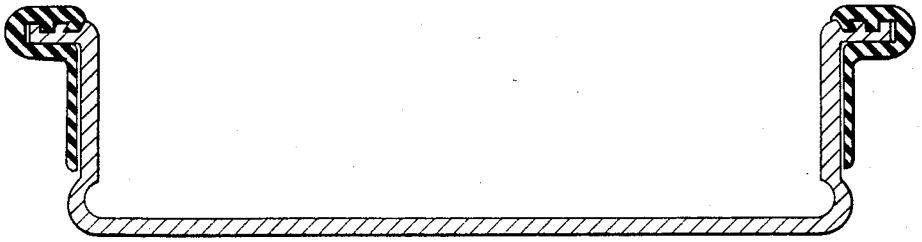

FIGS. 24 and 29 illustrate technical details of the basic frame element and the individual elements fixed therein.

FIG. 24 shows the way in which the extruded edge profiles abut at the frame corner. FIG. 24 also shows the rubber receiving ribs. The profiles have regularly distributed bores, which permit a fixing of the inserted and also engaged elements. These bores also are used for the passage of the fixing studs of the connected lateral elements.

Figure 25:
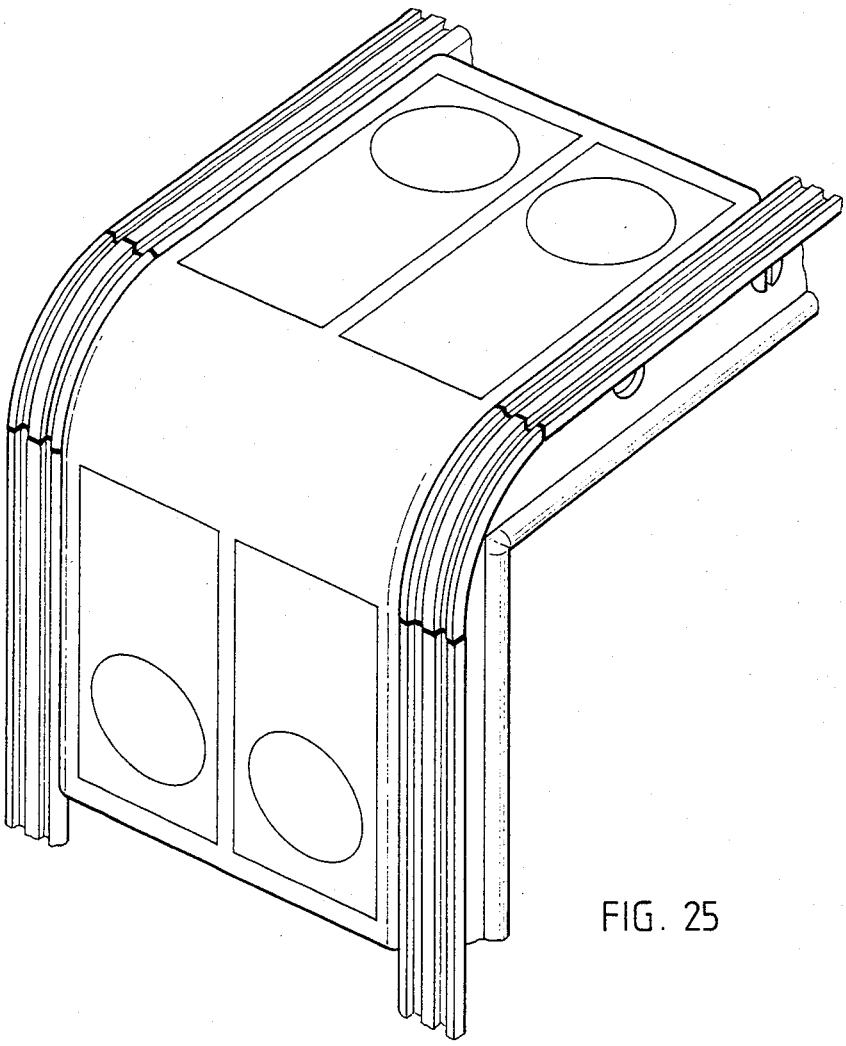

FIG. 25 shows the corner position of the basic frame with the die cast element inserted into the extruded profiles and into which are integrated the locking elements.

Figure 26:
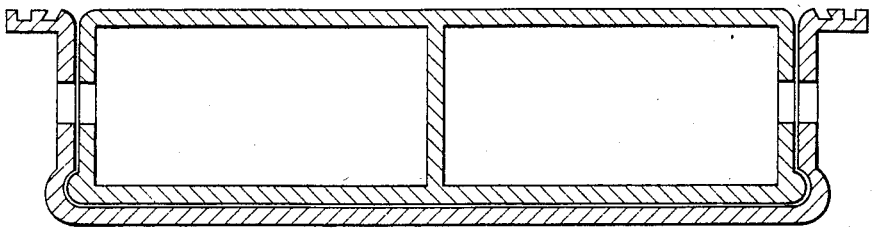
FIGS. 26–29 are side elevational views of basic frame elements with accessories according to the present invention.

FIG. 26 shows how the corner elements can be introduced into the bottom-widened frame rail. This possibility of fixing naturally also exists with the other statically loaded elements, such as carrying handle mounting or roller elements.

Figure 27:
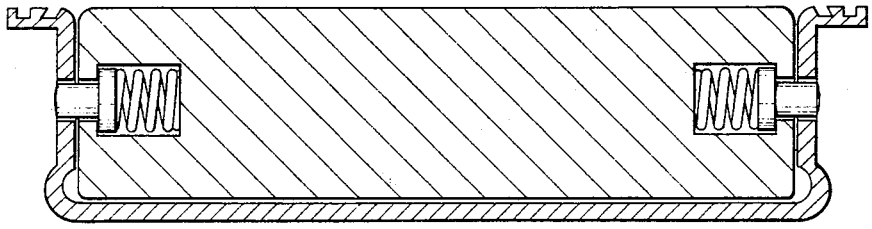

FIG. 27 shows how the elements can be subsequently engaged from above into the completed frame, the bores in the latter once again being used for fixing purposes. A typical fitting of this type can e.g. be a name plate or a clock.

Figure 28:
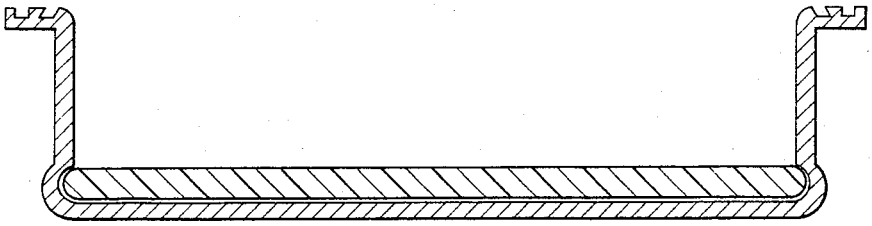

FIG. 28 also shows how a decorative surface can be incorporated into the lower, lateral widened portion in the basic frame profile, the edges of said surface being cleanly hidden in the profile.

FIG. 29 shows the edge protection rubber profile mounted or vulcanized onto the basic frame. It can also be used for sealing the frame against the lateral additional elements.

While various embodiments have been chosen to illustrate the invention, it will be understood by those skilled in the art that various changes and modifications can be made therein without departing from the scope of the invention as defined in the appended claims.

We claim:

1. A case, comprising:

a first rigid basic frame element defining a closed figure in plan view, said element including in transverse cross section a base member and two leg members extending radially outwardly and substantially perpendicularly from said base member at ends thereof, said base member being unitarily formed with said leg members as one piece, said base and leg members defining a laterally and outwardly opening recess, said base member having a substantially smooth inner surface;

connection means, on each side of said first basic frame element, for releasably coupling said first element to other, similar basic frame elements;

side members releasably coupled to said first basic frame element; and accessory means coupled to said first element in said recess and including locking members wholly located in said recess.

2. A case according to claim 1 wherein said base member is free of inwardly extending projections.

3. A case according to claim 1 wherein said accessory means are selected from the group consisting of lowerable carrying handles, name plates, identification elements, small accessories, roller elements and a carrying strap.

4. A case according to claim 1 wherein said closed figure is selected from the group consisting of a rectangle, square, polyon and circle.

5. A case according to claim 1 wherein a second basic frame element, similar to said first basic frame element, is coupled to said first basic frame element by said connecting means forming an overseas case.

6. A case according to claim 1 wherein said first basic frame element is in a horizontal orientation with top and bottom elements coupled to and bottom ends thereof forming a beauty case.

7. A case according to claim 1 wherein one of said side members comprises an autonomously usable unit releasably coupled to said first basic frame element.

8. A case according to claim 7 wherein said autonomously usable unit is foldable for use as a small bag.

9. A case according to claim 1 wherein said accessory means do not protrude beyond said recess.

* * * * *